US005816405A

United States Patent [19]

Carriger, Jr.

[11] Patent Number: 5,816,405

[45] Date of Patent: Oct. 6, 1998

[54] PORTABLE CATERING SYSTEM

[76] Inventor: Richard Carriger, Jr., 93 Gilson Rd., Scituate, Mass. 02066

[21] Appl. No.: 807,155

[22] Filed: Feb. 27, 1997

Related U.S. Application Data

[63] Continuation-in-part of Ser. No. 508,437, Jul. 28, 1995, abandoned.

[51] Int. Cl.[6] ..... A45C 11/20

[52] U.S. Cl. ..... 206/542; 206/546; 206/549

[58] Field of Search ..... 206/499, 541, 206/543–548, 549, 542, 546

[56] References Cited

U.S. PATENT DOCUMENTS

| | | | |
|---|---|---|---|
| 165,305 | 7/1875 | Carver | 206/541 |
| 264,248 | 9/1882 | Dabney | 206/541 |
| 1,607,024 | 11/1926 | Thomson | 206/499 X |
| 2,011,996 | 8/1935 | Belk | 206/549 |
| 2,623,656 | 12/1952 | Roltau | 206/499 X |
| 2,645,332 | 7/1953 | Martin et al. | 206/545 |
| 2,954,893 | 10/1960 | Sayre | 206/545 X |
| 3,093,238 | 6/1963 | King, III | 206/541 |
| 3,398,827 | 8/1968 | Laskin | 206/499 |
| 3,489,267 | 1/1970 | Carpenter | 206/541 |
| 3,811,559 | 5/1974 | Carter | 206/545 |
| 3,926,363 | 12/1975 | Catron | 206/499 X |
| 4,436,353 | 3/1984 | Tucker . | |
| 5,501,338 | 3/1996 | Preston | 206/545 |

*Primary Examiner*—Bryon P. Gehman
*Attorney, Agent, or Firm*—Steven N. Fox, Esq.

[57] ABSTRACT

Disclosed is a portable catering system for transporting, storing and serving food. In one embodiment, the portable catering system comprises first and second carrying cases, a first, second and third trays each having at least one cavity to store food, and an interconnect member. The portable catering system is operable from a transportation position to a dispensing position. In the transportation position, the trays are stacked upon each other and the first and second carrying cases are disposed about the stacked trays whereby the portable catering system may be carried or transported. In the dispensing position, the first and second carrying cases disassembled and spaced adjacent to each other and connected by the interconnect member whereby the first tray is supported on top of the first carrying case, the second tray is supported on top of the interconnect member and the third tray is supported on top of the second carrying case thereby allowing the food to be dispensed.

8 Claims, 6 Drawing Sheets

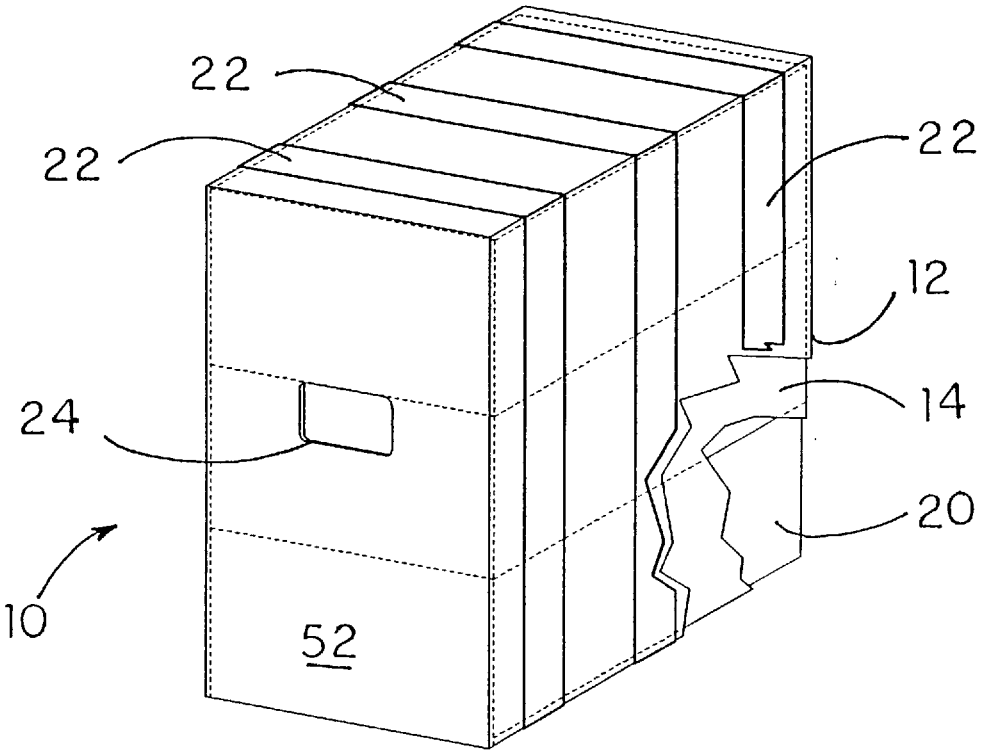
22
22
22
12
14
24
20
10
52
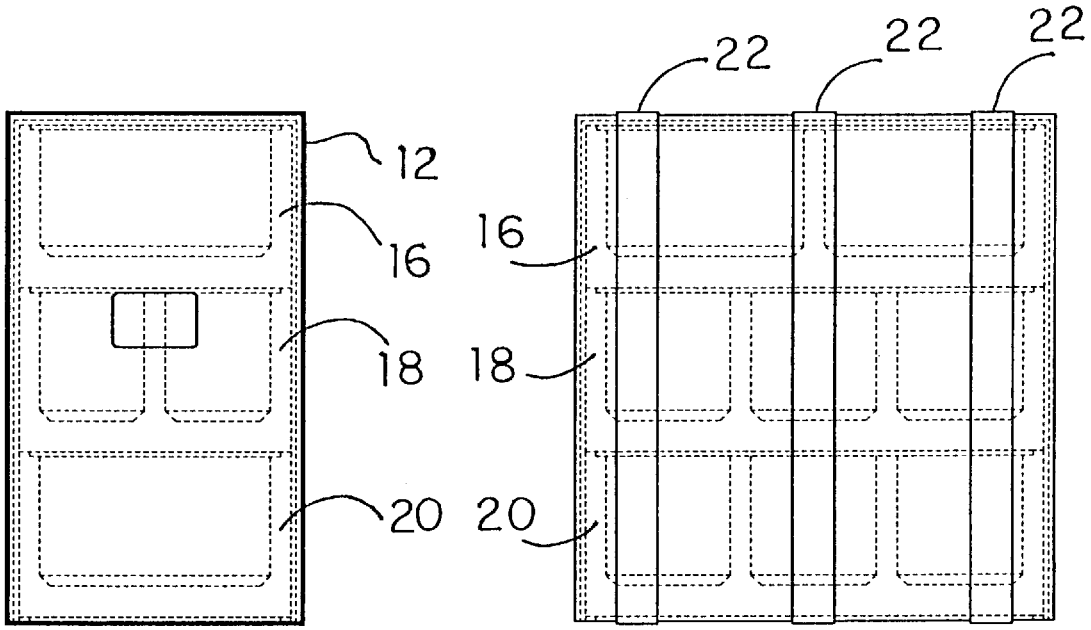
22
22
22
12
16
16
18
18
20
20

L
W
A
B
C
H
16
18
20
28
30
32
34
36
38
40
44
46

PORTABLE CATERING SYSTEM

This application claims priority to and is a continuation-in-part of application Ser. No. 08/508,437 filed on Jul. 28, 1995 now abandoned.

FIELD OF THE INVENTION

The present invention relates generally to food transportation, storage and serving systems. More specifically, the present invention relates to portable food transportation, storage and serving systems.

BACKGROUND OF THE INVENTION

People who attend events such as football games or concerts often desire to consume food prior to and/or during the event. Typically, such people either purchase prepared food at a local store or purchase unprepared food and prepare the same at the event. To transport and/or store the food, people often use conventional devices such as Styrofoam coolers. When service for several or more people is desired, several coolers are required. Although infrequently, some people may bring with them conventional devices such as folding tables to serve the food.

Food transportation, storing and serving systems of the above type have several disadvantages. First, several coolers are often necessary to transport and store the food. Use and transportation of multiple coolers is often inconvenient and undesirable. Second, coolers become dirty and unsanitary and must be replaced often. Third, few people are willing to go through the trouble of bringing a folding table to an event. The primary reason for this is that the folding table is difficult to transport and will become dirty and require cleaning after use. In such circumstances, people are forced to place the coolers on the ground or on some other object such as a car to serve the food.

SUMMARY OF THE PRESENT INVENTION

A primary object of the present invention is to provide a portable catering system whereby food, beverage or related products can be easily transported, stored and served.

Another object of the present invention is to provide a portable catering system that can be sold by a vendor to a purchaser with the desired food, beverage and related products already contained therein and which can then be easily transported, stored and served by the purchaser at the event site.

The above objects are realized by the present invention which is a portable catering system for transporting, storing dispensing food products and related items. In one embodiment, the portable catering buffet system comprises a carrying case and a series of stacked trays each having at least one cavity to store food. During transportation, the trays are stacked together and secured by the carrying case. To serve the food, the trays are unstacked and the carrying case is used as a table top to support the trays.

BRIEF DESCRIPTION OF THE DRAWINGS

The following detailed description of the present invention will become more fully understood with reference to the accompanying drawings in which:

FIG. 2 is a perspective view of the present invention;

FIGS. 3 and 4 are end and side views of present invention shown in FIG. 1, respectively, with the internal food trays shown in phantom;

DETAILED DESCRIPTION OF THE PREFERRED EMBODIMENTS

Figure 1:
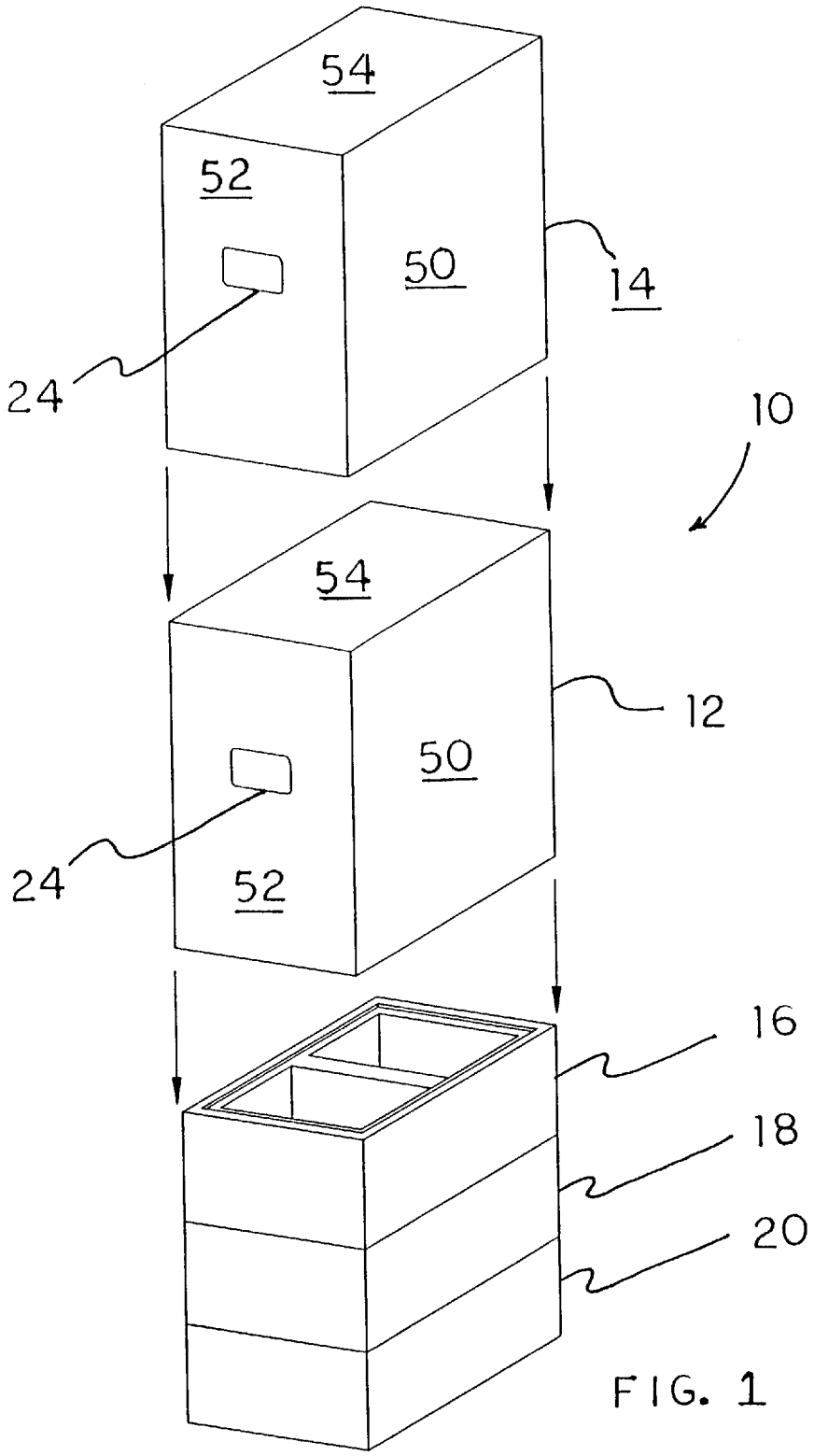
FIG. 1 is an exploded perspective view of the present invention.
Figures 5, 6, 7, 8, 9, 10:
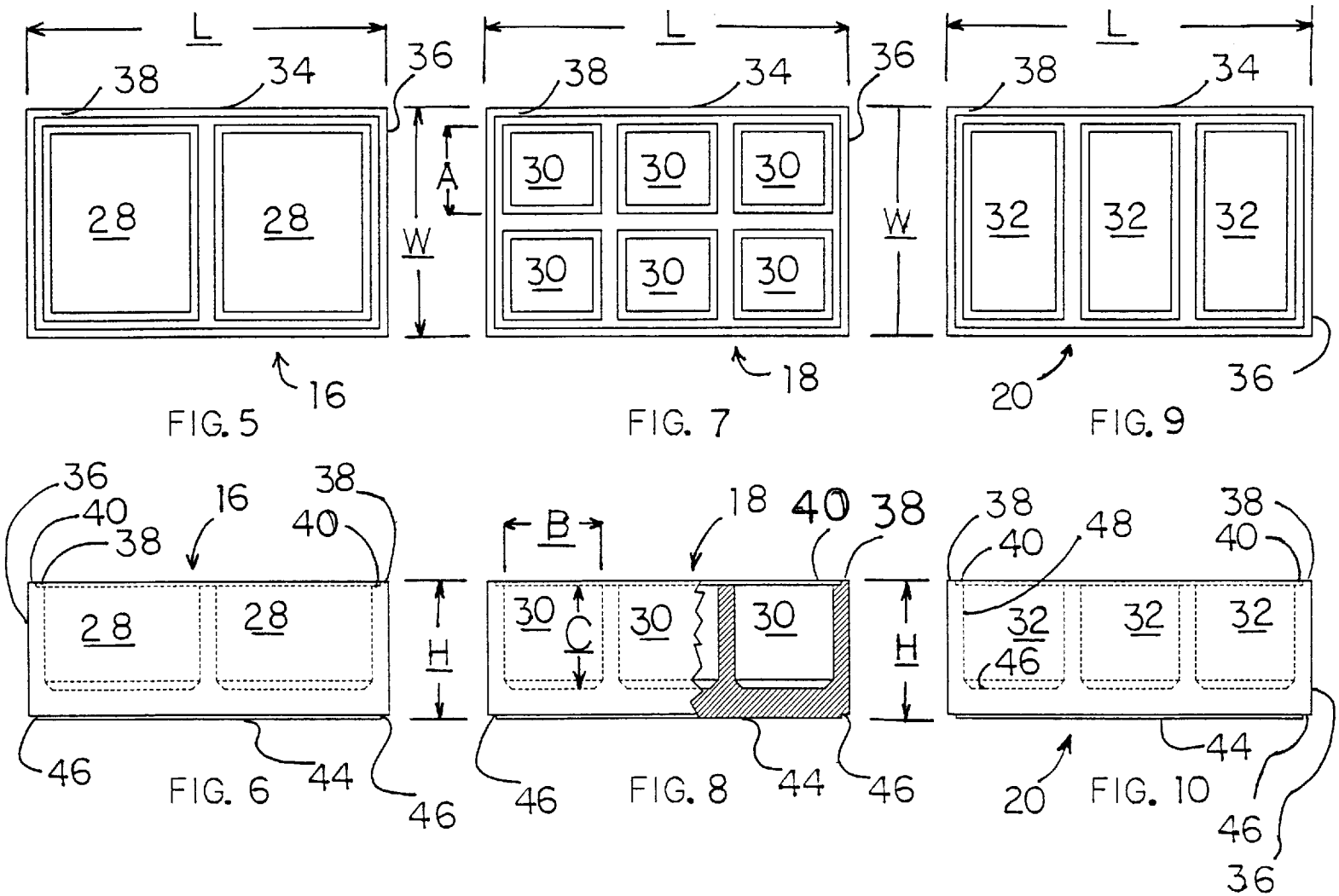
FIG. 5 is a top plan view of a two cavity tray of the present invention.
FIG. 6 is a cross-section view taken along line 6—6 of FIG. 5.
FIG. 7 is a top plan view of a six cavity tray of the present invention.
FIG. 8 is a cross-section view taken along either of lines 8—8 of FIG. 7.
FIG. 9 is a top plan view of a three cavity tray of the present invention.
FIG. 10 is a cross-section view taken along line 10—10 of FIG. 9.

Referring to FIGS. 1–4, where the portable catering system 10 of the present invention is shown in an assembled position. The portable catering system 10 generally comprises first and second carrying cases 12 and 14 and a series of stackable food trays 16, 18, and 20. The first carrying case 12 is mountable about the stacked trays 16, 18, and 20 while the second carrying case 14 is mountable about the first carrying case 12. The portable catering system 10 further comprises a plurality of plastic straps 22 to secure the assembly of the carrying cases 12 and 14 and stacked trays 16, 18, and 20.

The first carrying case 12 comprises a rectangular box-like configuration open at the bottom and having side walls 50, end walls 52, and a top wall 54. Each of the end walls 52 includes a rectangular hand-slot or cut-out 24 which acts as a handle to transport the portable catering system 10.

The second carrying case 14 is constructed in the same manner as first carrying case 12 except that the inner dimensions of the second carrying case 14 are larger than that of the first carrying case 12 to allow the second carrying case 14 to be easily placed upon and removed from the first carrying case 12. The second carrying case 14 is utilized to provide additional support during transportation as well as an additional table top to support the trays during serving.

When assembled, the stacked trays 16, 18 and 20 fit within the first carrying case 12 with the top wall 54 in superposed relation to the uppermost stacked tray which in the embodiment shown is tray 16. The subassembly of the stacked trays 16, 18 and 20 and the first carrying case 12 fit within the second carrying case 14 with the top wall 54 in superposed relation to the top wall 54 of the first carrying case 12. The first and second carrying cases 12 and 14 are preferably positioned such that the hand-slots 24 are aligned. The first and second carrying cases 12 and 14 are preferably made from heavy gauge cardboard material for durability during transportation and for use as a table top during serving of the food products.

As shown by FIGS. 5–10, tray 16 comprises two cavities 28, tray 18 comprises six cavities 30, and tray 20 comprises three cavities 32. In the preferred embodiment, the trays 16, 18, and 20 are formed from Styrofoam and are of generally rectangular shape. In the preferred embodiment, the length 1 of the trays 16, 18 and 20 is 22.0 inches, while the width w of the trays is 13.75 inches and the height h of the trays is 8.25 inches.

Each of the trays 16, 18 and 20 comprise long walls 34 and short walls 36. The long walls 34 and the short walls 36 have a thickness of about one (1.0) inch and comprise a top surface 38 and a first shoulder 40 having a width of about one-half (0.5) inch and which is continuously formed adjacent to the top surface 38. Each of the trays 16, 18, and 20 further comprise a base 44 and a second shoulder 46 having a width of about one-half (0.5) inch and which extends continuously around the periphery of the base 44. The first shoulder 40 and the second shoulder 46 are provided such that trays 16, 18 and 20 may be stacked on top of each other during transportation, by for example, engaging the second shoulder 46 of the tray 16 with the first shoulder 40 of the tray 18, and engaging the second shoulder 46 of the tray 18 with the first shoulder 40 of the tray 20.

The trays 16, 18 and 20 may be formed with more or less than six cavities but the external dimensions of the trays should preferably remain the same. The greater the number of cavities or bins, the smaller are the dimensions of the individual cavities. For example, in the six cavity tray 18, each cavity 30 has a width a of 5.375 inches, a length b of 6.000 inches, and a height c of 6.500 inches. Each of the cavities 28, 30, and 32 comprise a bottom surface 46 and inner walls 48. The inner walls 48 are angled at 45 degrees at its jointure with the bottom surface 46 for ease of manufacture.

In operation, food, eating utensils, napkins, table cloth etc. are initially stored inside cavities 28, 30, and 32 of the trays 16, 18 and 20, respectively. Thereafter, the trays 16, 18 and 20 are stacked as heretofore described. When the portable catering system 10, which has been transported to the site of the buffet by truck or van for example, arrives at the site, the straps 22 are cut and the first carrying case 12 and the second carrying case 14 are lifted from the stacked trays 14, 16, and 18. Thereafter, the first and second carrying cases 12 and 14 are positioned next to each other with their top walls 54 facing upward to form a table and the trays 16, 18, and 20 are unstacked and placed upon the top walls 54 for serving. After use, the trays 16, 18 and 20 and the carrying cases 12 and 14 may be discarded.

FIGS. 11–16, show a second embodiment of the present invention wherein the portable catering system 12 further comprises an interconnect member 60 which is adapted to engage with first carrying case 12 and second carrying case 14 to thereby provide additional area in which to support trays 16, 18, and 20 and to provide a rigid and secure assembled unit during dispensing. In the embodiment shown, the first tray 16 is disposed upon the first carrying case 12, the second tray 18 is disposed upon the interconnect member 60, and the third tray 20 is disposed upon the second carrying case 14. The interconnect member 60 generally comprises a top portion 78 and first and second side panels 64 and 66 which are foldable about cut or scored lines 68. The carrying cases 12 and 14 are provided with a slot or elongated opening 62 and 63, respectively, along one of its sides 50. First and second side panels 64 and 66 are adapted to insert into slots 62 and 63, respectively. The interconnect member 60 further comprises end portions 70 each having an end panel 72 which is foldable about a cut or score line 74 and a slot portion 76. The end panels 72 are adapted to provide additional rigidity to the portable catering device 10 when it is assembled into the dispensing position.

Figure 11:
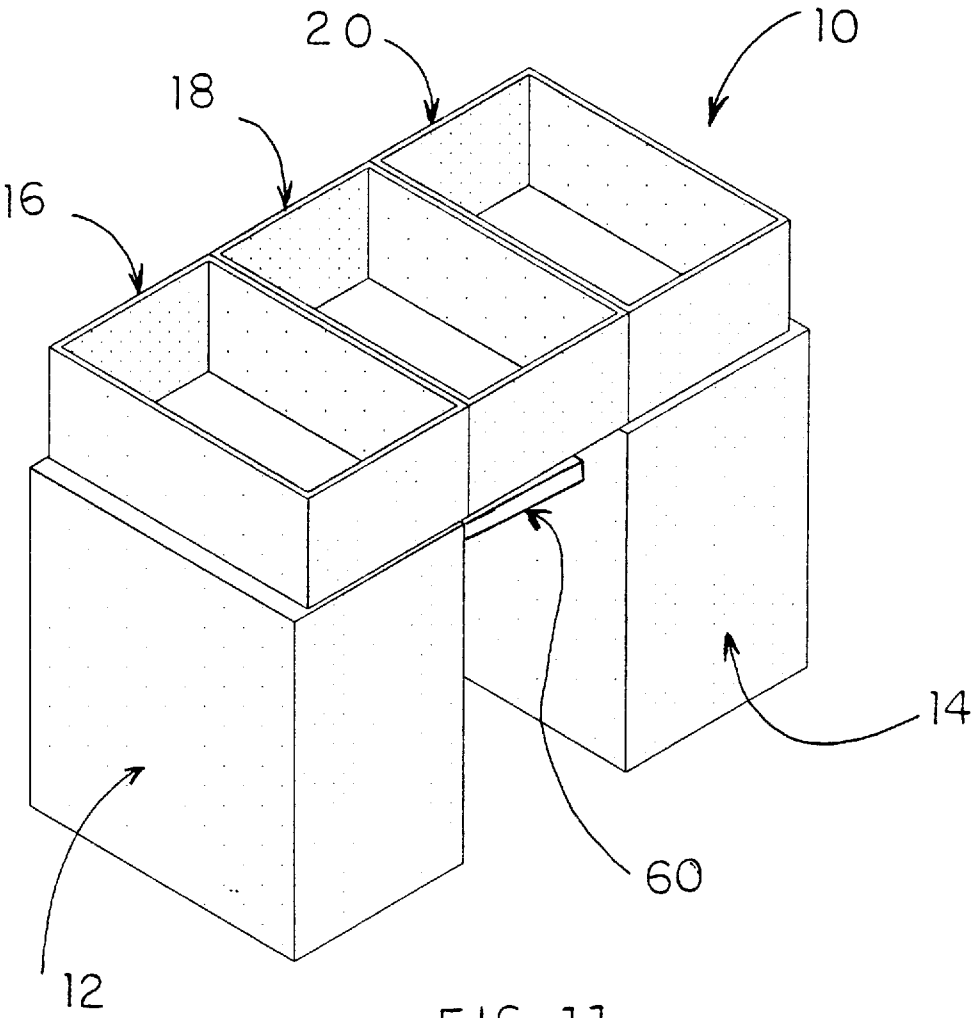
FIG. 11 is a perspective view of a second embodiment of the present invention shown in the dispensing position with the trays mounted thereon.
Figure 12:
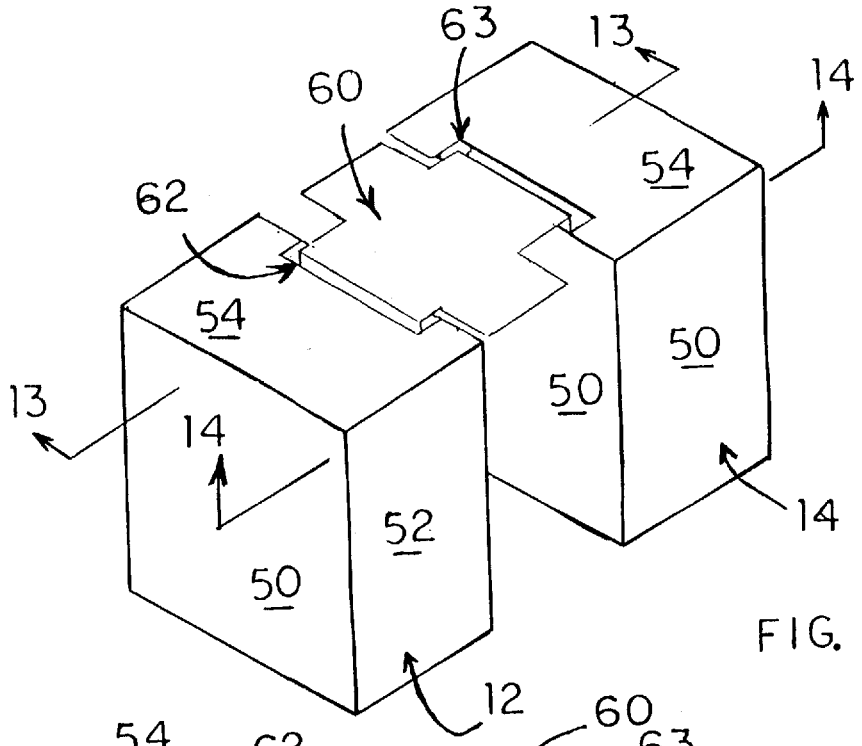
FIG. 12 is a perspective view of the second embodiment shown in the dispensing position without the trays mounted thereon.
Figure 13:
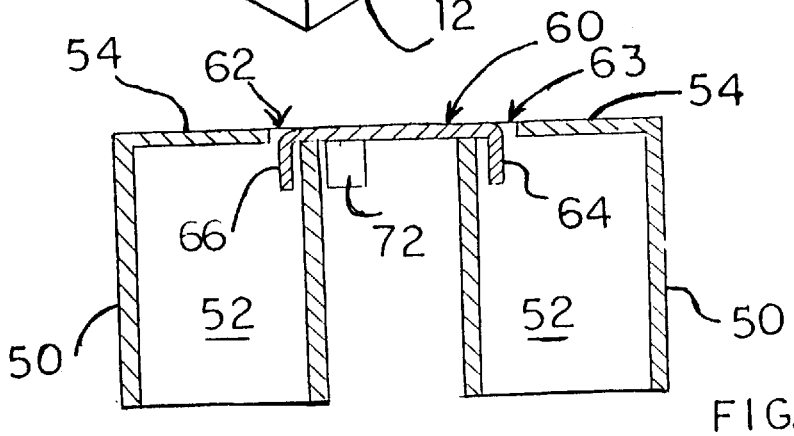
FIG. 13 is a cross-section view taken along line 13—13 of FIG. 12.
Figure 14:
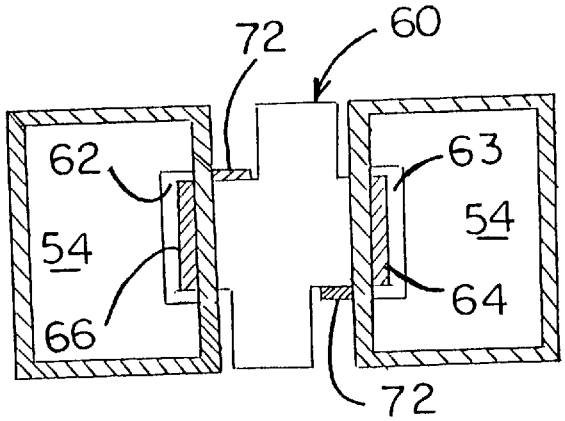
FIG. 14 is a cross-section view taken along line 14—14 of FIG. 12.
Figure 15:
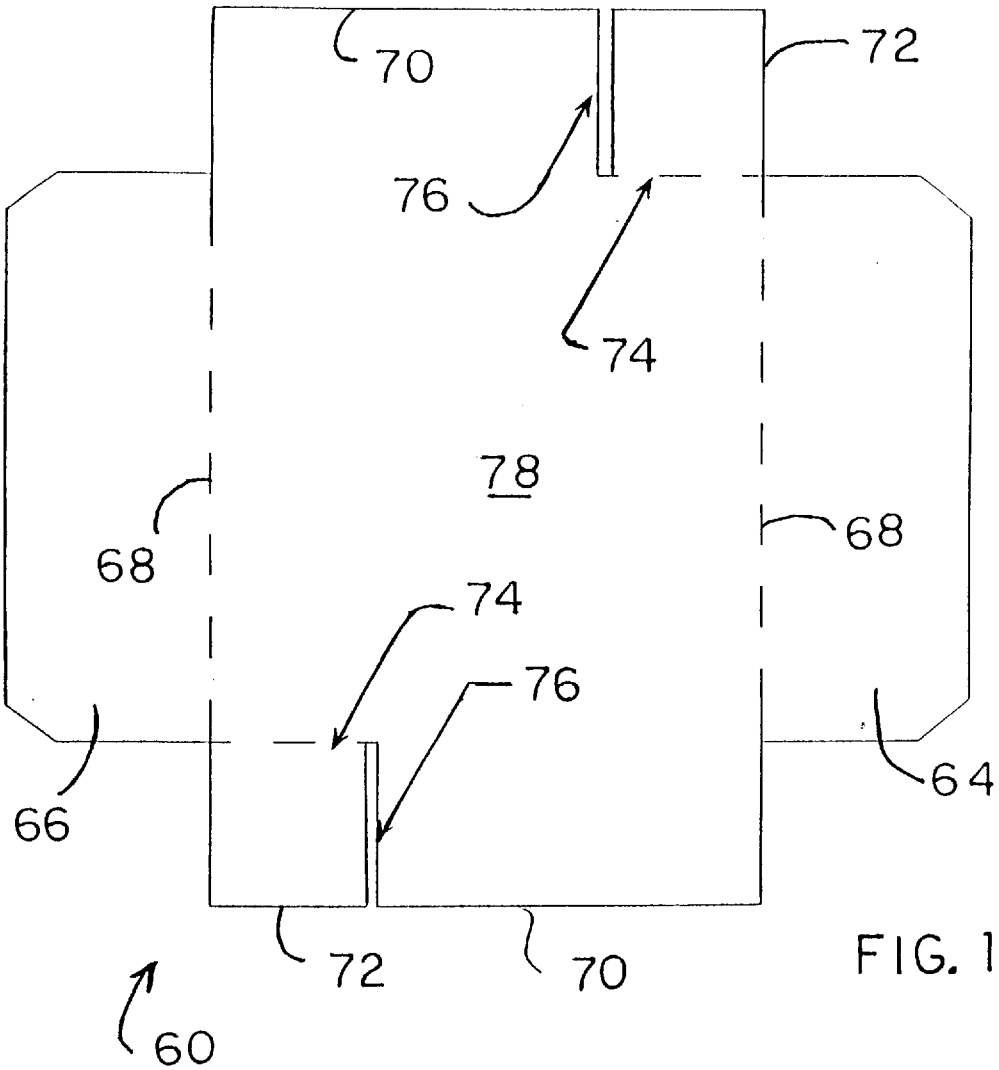
FIG. 15 is a plan view of the inter-connect portion.
Figure 16:
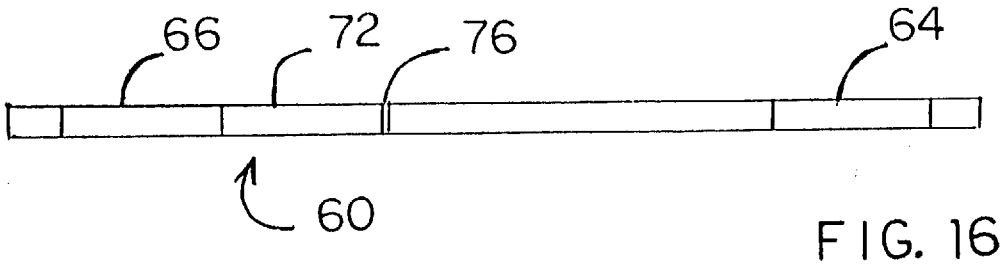
FIG. 16 is a front elevation view of the inter-connect portion.

The portable catering system 10 is operable from a transportation position (FIGS. 1–4) to a dispensing position (FIGS. 11 and 12). In the transportation position, the second tray 18 is stackable upon said third tray 20 and the first tray 16 is stackable upon the second tray 18. The first carrying case 12 is disposed about or slid over stacked trays 16, 18, and 20 and the second carrying case 14 is disposed about or slid over the first carrying case 12, and the side portion 64 of the interconnect member 60 is engaged with or inserted into the slot 63 of the second carrying case 14. Straps 22 are placed around the assembly whereby the portable catering system 10 may be transported. In the dispensing or assembled position, the straps 22 are discarded and the first and second carrying cases 12 and 14 are disassembled and spaced adjacent to each other with the slots 62 and 63 facing each other. The first and second side portions 64 and 66 of the interconnect member 60 are engaged with or inserted into the slots 62 and 63 of the first and second carrying cases 12 and 14, respectively. Thereafter, the first tray 16 is positioned and supported on top of the first case 12, the second tray 18 is positioned and supported on top of the interconnect member 60 and the third tray 20 is positioned and supported on top of the second carrying case 20, whereby the food within the trays 16, 18, and 20 can be dispensed.

Although two carrying cases 12 and 14 have been shown, the system 10 may be configured with three or more carrying cases whereupon in the dispensing position, suhc three or more carrying cases are placed adjacent to one another thereby providing surface area on which to support all of the trays above the ground In this embodiment, the interconnect member would not be necessary. The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A portable catering system for transporting, storing, and serving food comprising:

a first carrying case comprising first and second side walls, a top portion, an open bottom portion, and a mounting opening;

a second carrying case comprising first and second side walls, a top portion, an open bottom portion, and a mounting opening;

a first tray having at least one cavity to store food;

a second tray having at least one cavity to store food;

a third tray having at least one cavity to store food;

an interconnect member having a top portion and respective first and second side portions;

said portable catering system being operable from a transportation position to a dispensing position;

said transportation position being said second tray stacked upon said third tray, said first tray stacked upon said second tray, said first and second carrying cases being disposed about said stacked trays; and said dispensing position being said first and second carrying cases are spaced apart and disposed adjacent to each other and said first and second side portions of said interconnect member are engaged with said mounting openings of said first and second carrying cases, respectively, and said first tray is supported on said top portion of said first carrying case, said second tray is supported on said top portion of said interconnect member and said third tray is supported on said top portion of said second carrying case.

2. The system of claim 1, wherein said first and second side portions of said interconnect member are each foldable about score lines.

3. The system of claim 1, wherein said mounting openings of said first and second cases are each in the form of a slot.

4. The system of claim 1 further comprising at least one strap disposed around said first and second carrying cases in said transportation position.

5. The system of claim 1, wherein said first side portion of said interconnect member is engaged with said mounting opening of said second carrying case in said transportation position.

6. The system of claim 1, wherein said first and second carrying cases and said first, second, and third trays are each of rectangular shape.

7. The system of claim 1, wherein said first, second and third trays each comprise a plurality of cavities.

8. The system of claim 1, wherein said top portion of each of said first and second carrying cases is substantially solid.

* * * * *